US009610776B2

(12) United States Patent
Kawai et al.

(10) Patent No.: US 9,610,776 B2
(45) Date of Patent: Apr. 4, 2017

(54) CONNECTION MEMBER AND INKJET RECORDING DEVICE EQUIPPED WITH THE CONNECTION MEMBER

(71) Applicant: MIMAKI ENGINEERING CO., LTD., Nagano (JP)

(72) Inventors: Tomoya Kawai, Nagano (JP); Eiji Miyashita, Nagano (JP); Akihiko Mizusaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/027,430

(22) PCT Filed: Oct. 1, 2014

(86) PCT No.: PCT/JP2014/076325

§ 371 (c)(1),
(2) Date: Apr. 5, 2016

(87) PCT Pub. No.: WO2015/053154

PCT Pub. Date: Apr. 16, 2015

(65) Prior Publication Data

US 2016/0243840 A1 Aug. 25, 2016

(30) Foreign Application Priority Data

Oct. 7, 2013 (JP) ..... 2013-210580

(51) Int. Cl.
*B41J 2/175* (2006.01)
*B41J 2/01* (2006.01)
*B41J 2/14* (2006.01)

(52) U.S. Cl.
CPC ..... *B41J 2/1752* (2013.01); *B41J 2/01* (2013.01); *B41J 2/17523* (2013.01); *B41J 2002/14491* (2013.01)

(58) Field of Classification Search
CPC ..... B41J 2/1752
See application file for complete search history.

(56) References Cited

U.S. PATENT DOCUMENTS

2005/0151764 A1* 7/2005 Grady ..... B41J 2/17509 347/7

FOREIGN PATENT DOCUMENTS

CN 1820954 8/2006
CN 202071509 12/2011
(Continued)

OTHER PUBLICATIONS

"International Search Report (Form PCT/ISA/210)", with English translation thereof, mailed on Jan. 13, 2015, pp. 1-5.
(Continued)

*Primary Examiner* — Julian Huffman
(74) *Attorney, Agent, or Firm* — Jianq Chyun IP Office

(57) ABSTRACT

A connection member is provided that can be fabricated at low cost and easily attached to a target component. The connection member is a member to be connected to and to communicate with a first component. The connection member is further connectable to another connection member to be connected to and to communicate with a second component. The connection member includes a communicating portion connectable to and communicatable with the first component, engaging portions engageable into the other connection member, and engaged portions into which the other connection member is engageable. These connection members are mutually connectable to communicate with each other.

3 Claims, 6 Drawing Sheets

(56) References Cited

FOREIGN PATENT DOCUMENTS

| | | |
|---|---|---|
| JP | 07-145896 | 6/1995 |
| JP | 2003-159818 | 6/2003 |
| JP | 2004-268599 | 9/2004 |
| JP | 2012-061624 | 3/2012 |

OTHER PUBLICATIONS

"First Office Action of China Counterpart Application" with English translation thereof, issued on Aug. 19, 2016, p. 1-p. 14.

* cited by examiner

CONNECTION MEMBER AND INKJET RECORDING DEVICE EQUIPPED WITH THE CONNECTION MEMBER

CROSS-REFERENCE TO RELATED APPLICATION

This application is a 371 application of an International PCT application serial no. PCT/JP2014/076325, filed on Oct. 1, 2014, which claims the priority benefits of Japan Application No. JP 2013-210580, filed on Oct. 7, 2013. The entirety of each of the above-mentioned patent applications is hereby incorporated by reference herein and made a part of this specification.

TECHNICAL FIELD

The present invention relates to a connection member for use in connecting two different components in a manner that the components can communicate with each other, and an inkjet recording device equipped with the connection member.

BACKGROUND ART

Conventionally, connection members may be used as means for connecting two different components to establish communication between the components. For instance, some inkjet recording devices use ink feed tubes as a connection member that connects recording heads and an ink storage tank to allow them to communicate with each other. The ink feed tubes are connected to the recording heads, and the ink storage tank is connected to the ink feed tubes. The ink in the storage tank runs through the ink feed tubes into the recording heads.

Patent Document 1 discloses an ink feeding structure wherein a storage tank and recording heads are connected with such ink feed tubes. The ink feeding structure disclosed in this document uses first and second joint members to connect the storage tank and the recording heads. The first joint members are connected to ink guiding tubes connected to the recording heads, and the second joint members are connected to ink guiding tubes connected to the storage tank. Then, the first and second joint members are connected to allow the recording heads and the storage tank to communicate with each other.

PRIOR ART DOCUMENT

Patent Document

Patent Document 1: JP 2004-268599 A (disclosed on Sep. 30, 2004)

SUMMARY

Technical Problems

The ink feeding structure described in Patent Document 1 is effectuated by inserting the first joint member in the second joint member. Such a structure that uses an external member and an internal member for connection requires the fabrication of these two different members. This doubles the die cost, consequently increasing an overall production cost. Additionally, the external member and the internal member need to be discerned and then attached to two components to be connected. This is rather a laborsome procedure.

To address these conventional issues, the present invention provides a connection member that can be fabricated at low cost and easily attached to a target component, and an inkjet recording device equipped with the connection member.

Solutions to the Problems

A connection member according to an aspect of the present invention is a connection member to be connected to and to communicate with a first component, the connection member being further connectable to another connection member to be connected to and to communicate with a second component, the connection member including: a communicating portion connectable to and communicatable with the first component; an engaging portion engageable into the other connection member; and an engaged portion into which the other connection member is engageable, wherein the connection member and the other connection member are mutually connectable to communicate with each other.

According to this aspect, by engaging the connection member and the other connection member with each other, the first component connected to and communicating with the communicating portion of the connection member and the second component connected to and communicating with another communicating portion of the other connection member may be mutually connected to communicate with each other. The connection member according to this aspect engages into the other connection member, while receiving the other connection member engaged therein. In other words, the connection member has two portions; an engaging portion that engages into the other connection member, and an engaged portion into which the other connection member is engaged. Since the two connection members according to this aspect are thus engageable with each other, the external and internal members can be dispensed with. When these connection members are attached to two components to be connected, therefore, discerning external and internal members, as in the conventional art, is unnecessary, markedly facilitating the workload. It is particularly advantageous to use two connection members of one type that requires only one die to fabricate them. This may reduce the die cost as compared to the conventional example that requires the fabrication of external and internal members, consequently curtailing an overall production cost.

In the connection member according to a further aspect of the present invention, the engaging portion may be located at a position closer to the communicating portion than the engaged portion, and the engaging portion and the engaged portion may be spaced at an interval.

According to this aspect, an interval between the engaging portion and the engaged portion may serve to increase a degree of engagement between the connection member and the other connection member. As a result, a larger engaging intensity (engaging force) may be attainable, making the connection member and the other connection member inseparable.

According to a further aspect of the present invention, the communicating portion of the connection member may have a tubular shape, and the communicating portion may have a part having a largest aperture whose side surface is parallel to a lengthwise direction thereof.

According to this aspect, the part having a largest aperture at the connecting end of the communicating portion has a side surface parallel to the lengthwise direction. Then, fully intimate contact may be achieved between the part having a largest aperture and the inner surface of the component's connecting port. This may improve sealing properties between the communicating portion and the connecting port of the component, making the connection member and the component inseparable. Because of the improved sealing properties between the communicating portion and the connecting port of the component, any displacement of the connecting port of the component is unlikely to result in a gap between the communicating portion and the connecting port. This may avoid possible leakage of fluid (for example, ink) through such a gap.

In the connection member according to a further aspect of the present invention, the communicating portion may have a part having a smallest aperture whose side surface is parallel to the lengthwise direction at a lower end thereof than the part having a largest aperture, and the communicating portion may further have, at a position opposite to the part having a smallest aperture across the part having a largest aperture, a part larger in aperture than the part having a smallest aperture and smaller in aperture than the part having a largest aperture (i.e., a part having a mid-sized aperture), wherein the part having a mid-sized aperture has a side surface parallel to the lengthwise direction.

According to this aspect, the part having a smallest aperture and the part having a mid-sized aperture at the connecting end of the communicating portion respectively have side surfaces parallel to the lengthwise direction. Then, fully intimate contact may be further ensured between the inner surface of the component's connecting port and the part having a largest aperture, the part having a smallest aperture, and the part having a mid-sized aperture. This may further improve sealing properties between the communicating portion and the connecting port of the component, making the connection member and the component more inseparable.

At the connecting end of the communicating portion, a stepwise part is formed between the part having a largest aperture and the part having a mid-sized aperture. Such a stepwise part (unevenness) may make the communicating portion and the connecting port of the component even more inseparable.

To address the issues of the prior art, an inkjet recording device according to an aspect of the invention includes any one of the connection members so far described.

By using any one of the connection members thus advantageous and fabricated at low cost, a plurality of components in the inkjet recording device may be easily connected.

Effects of the Invention

According to an aspect of the present invention, the components may be engageable with each other using two connection members, making external and internal members unnecessary. When these connection members are attached to two components to be connected, therefore, discerning external and internal members, as in the conventional art, is unnecessary, markedly facilitating the workload. It is particularly advantageous to use two connection members of one type that requires only one die to fabricate them. This may reduce the die cost as compared to the conventional example that requires the fabrication of external and internal members, consequently curtailing an overall production cost.

DESCRIPTION OF EMBODIMENTS

Referring to the accompanying drawings, embodiments of the present invention are hereinafter described in detail. In the description given below, any structural components with the same function and exerting the same effect are illustrated with the same reference symbol, and description of such structural components is omitted.

A connection member according to the invention may be for use in connecting two components. The connection member may be unlimitedly applicable to various fields and any parts of devices in which the connection member is utilizable. The connection member according to the invention is hereinafter described by way of embodiments wherein the connection member is applied to an inkjet recording device.

[Connection Member-Utilizable Device Parts]

Figure 2:
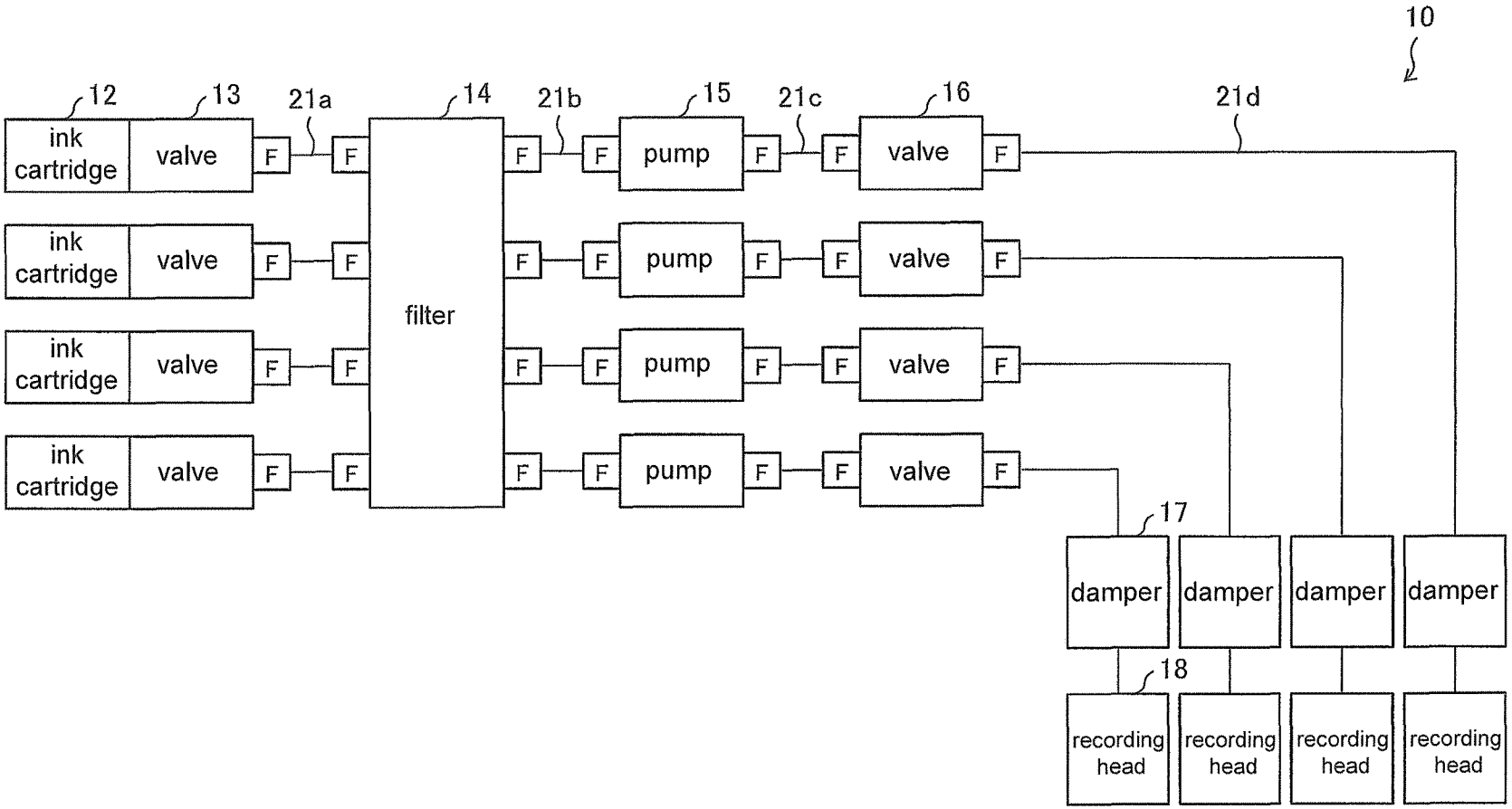
FIG. 2 is a block diagram of an ink supply unit in an inkjet recording device according to an embodiment of the invention.

In the inkjet recording device, a connection member according to an embodiment is used in an ink supply unit. In advance of description of the connection member, the ink supply unit of the inkjet recording device is briefly described referring to FIG. 2. FIG. 2 is a block diagram of an ink supply unit 10 in the inkjet recording device according to this embodiment.

As illustrated in FIG. 2, the ink supply unit 10 is structured to allow inks to circulate between ink cartridges 12 and recording heads 18. The ink cartridges 12 each have an openable and closable valve 13. To the valve 13 are connected, in the mentioned order, a filter 14 for removal of foreign matter from the ink, a pump 15 as a driving source that circulates the ink passing through the filter 14 to the recording head 18, and an openable and closable valve 16. To the valve 16 are connected, in the mentioned order, a damper 17 that regulates the supply pressure of the ink to be supplied to the recording head 18, and the recording head 18. When the pressure in the damper 17 is lowered in response to the ink discharge through the discharge nozzle (not illustrated in the drawings) of the recording head 18, the damper 17 opens the valve 13 and the valve 16 to circulate the ink from the ink cartridge 12 to the recording head 18 for refill.

Thus, the ink supply unit 10 includes different components that are connected to one another. The connection member according to this embodiment may be used to connect a first pipe 21*a* and a valve 13 in this structure. The connection member according to this embodiment may also be used to connect a first pipe 21*a* and a filter 14 in this structure. Moreover, the connection member according to this embodiment may also be used to connect other components, for example, second pipe 21*b* and filter 14, second pipe 21*b* and pump 15, third pipe 21*c* and pump 15, third pipe 21*c* and valve 16, or fourth pipe 21*d* and valve 16. For convenience, a simpler term, "component", may hereinafter refer to these parts of the device.

[Structural Features of Connection Member]

Figure 1:
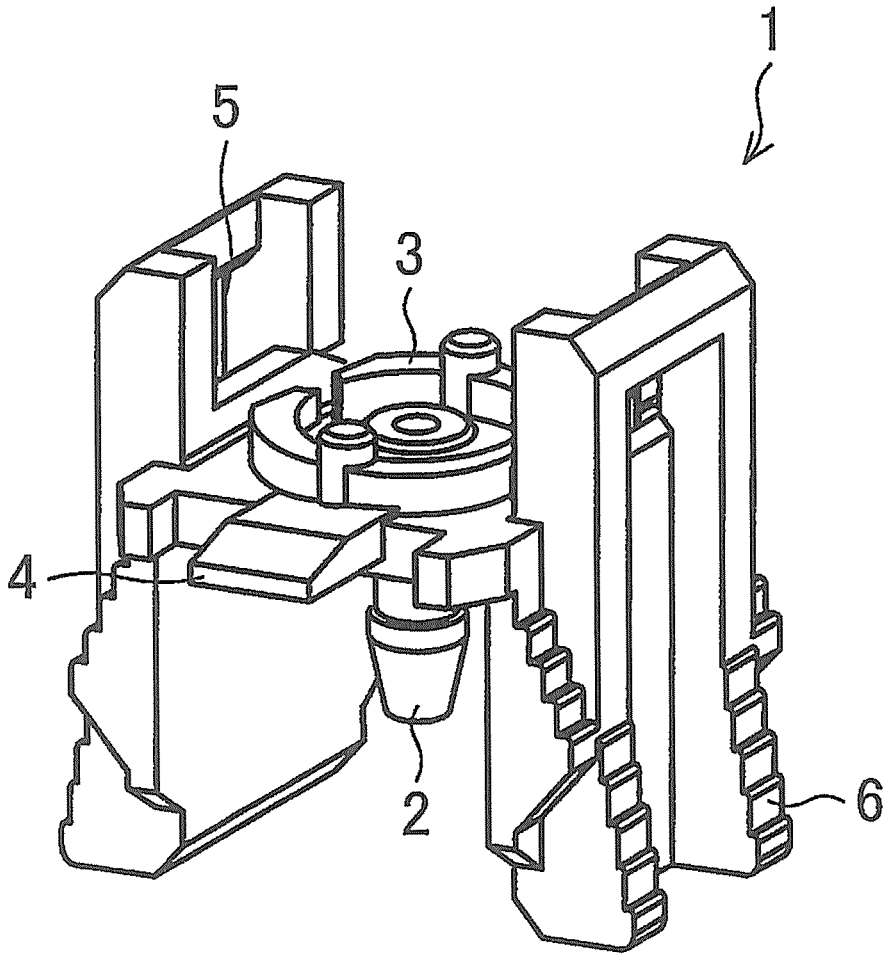
FIG. 1 is a perspective view of a connection member according to an embodiment of the invention.

FIG. 1 is a perspective view of the connection member according to this embodiment. As illustrated in FIG. 1, the connection member 1 has a communicating portion 2, a mating portion 3, engaging portions 4, engaged portions 5, and holding portions 6. The communicating portion 2 has a tubular shape and is connected to and communicating with one of the components described above (for example, valve 13) at one end thereof (lower end in the drawing). The communicating portion 2, by being inserted in a connecting port of the component, is connected to and communicating with the component. The mating portion 3 is communicatably formed at the other end (upper end in the drawing) of the communicating portion 2. The mating portion 3 has the engaging portions 4 and the engaged portions 5. The holding portions 6 are formed at end parts of the engaged portions 5 closer to the component. The drawing shows two engaging portions 4 formed at opposite positions on the side surface of the mating portion 3. The drawing also shows two engaged portions 5 formed at opposite positions across the two engaging portions 4. The numbers of these portions are given as non-limiting examples. The connection member 1 may have an optional number of engaging portions 4 and/or engaged portions 5.

The engaging portions 4 of the connection member 1 engage into another connection member, while the other connection member engages into the engaged portions 5 of the connection member 1. The other connection member refers to a connection member to be connected to and to communicate with the component. The other connection member may have a communicating portion. The communicating portion is connectable and communicatable with the component at one end thereof and has a mating portion at the other end thereof. For convenience, "another (the other) communicating portion" may refer to the communicating portion of another (the other) connection member, and "another (the other) mating portion" may refer to the mating portion of another (the other) connection member in the description hereinafter given.

The mating portion 3 is communicatably mated with the other mating portion of the other connection member. The other mating portion is formed so as to communicate with the other communicating portion. The connection member 1 according to this embodiment engages into the other connection member, while receiving the other connection member engaged therein. By using these connection members thus engageable, the component connected to and communicating with the communicating portion of the connection member 1 and the component connected to and communicating with the other communicating portion of the other connection member may be mutually connectable to communicate with each other.

For the engagement between the connection member 1 and the other connection member, the engaging portion 4 has a shape allowed to engage into the other connection member (for example, protrusion or claw). On the other hand, the engaged portion 5 has a shape allowed to receive the other connection member engaged therein (for example, opening or groove). FIG. 1 shows the engaging portion 4 in the form of a claw and the engaged portion 5 in the form of an opening. These shapes are, however, non-limiting examples. The mating portion 3 has such a shape that allows this mating portion and the other mating portion of the other connection member to be capable of mating with each other (for example, a shape complementary to the shape of the other mating portion). It is necessary for the mating portion 3 and the other mating portion of the other connection member to be communicatably mated with each other. Therefore, an end part of the communicating portion 2 at which the mating portion 3 is formed is coincident in shape with an end part of the other communicating portion at which the other mating portion is formed.

The holding portions 6 are for gripping the connection member 1 when the connection member 1 is engaged with the other connection member. By gripping the two holding portions 6 from two outer sides of the connection member 1 in a manner that these holding portions 6 approach each other, the two engaged portions 5 may be deflected outward on both sides of the connection member 1 away from each other. This deflection of the engaged portions 5 may be usefully leveraged to engage the connection member 1 and the other connection member. As a result, these connection members may be mutually engageable with ease.

The holding portions 6 may facilitate disengagement, as well as the engagement, between the connection member 1 and the other connection member. The component connected to and communicating with the communicating portion 2 of the connection member 1 may be replaced or regularly inspected. The component could be removable directly from the communicating portion 2 of the connection member 1. This is, however, impractical due to possible difficulty in removing the component or the risk of loosening the connection between the communicating portion 2 and the component after repeated removals. On the other hand, removing the connection member 1 and the component altogether by gripping the holding portions 6 may facilitate the removal work and hardly affect the connection between the communicating portion 2 and the component.

A non-slip material may be attached to the holding portion 6 as illustrated in FIG. 1. Attaching the non-slip material to the holding portions 6 may make it easier to grip the holding portions 6 and help to readily know the location of the holding portions 6 in the connection member 1.

The raw material of the connection member 1, though not particularly limited, may preferably be a substance resistant to solvent attack, such as polypropylene (PP) or polybutylene terephthalate (PBT), when a solvent ink is the fluid running through the communicating portion 2 of the connection member 1. Of these examples, the PP that makes the connection member 1 easier to deflect may be the most suitable material. The PP-based connection member 1, if colored in black, may be usable when an ultraviolet-curable ink is the fluid running inside. Polyoxymethylene (POM) may be usable at sections of the connection member 1 with no contact with the solvent ink.

[An Exemplified Engagement Setup of Connection Member]

Figure 3A:
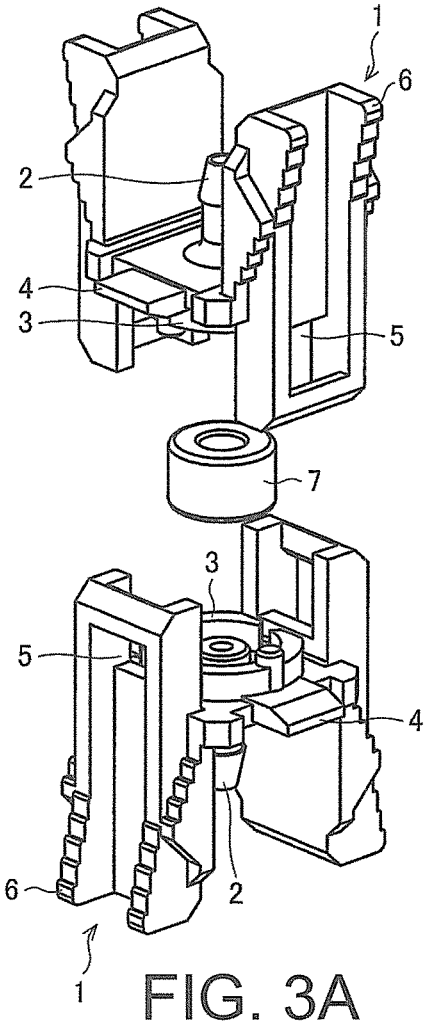
FIGS. 3A to 3C are respectively an exploded view, a perspective view, and a sectional view of two connection members being engaged with each other.
Figure 3B:
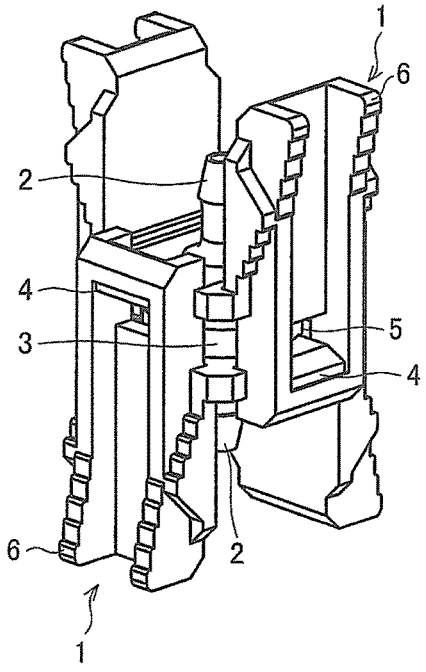
Figure 3C:
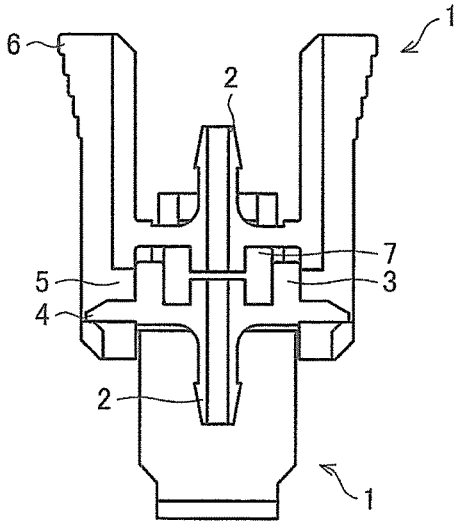

For example, this connection member 1 may be engageable with another connection member 1. FIGS. 3A to 3C illustrate the engagement of two connection members 1. FIGS. 3A to 3C are respectively an exploded view, a perspective view, and a sectional view of two connection members 1 being engaged with each other.

As illustrated in FIG. 3A, one of the connection members 1 and the other one of the connection members 1, being oriented oppositely, are engaged each other. Specifically, these members are engaged in a manner that the engaging portions 4 in one of the connection members 1 are oriented opposed to the engaged portions 5 in the other one of the connection members 1. As illustrated in FIG. 3B, the engaging portions 4 in one of the connection members 1 engage into the engaged portions 5 in the other one of the connection members 1, while the engaging portions 4 in the other one of the connection members 1 engage into the engaged portions 5 in one of the connection member 1. Then, the mating portion 3 in one of the connection members 1 and the mating portion 3 in the other one of the connection members 1 are mated with each other as illustrated in FIG. 3C. A rubber material 7 is inserted in between the two mating portions 3 to prevent possible leakage through any gap possibly generated between the communicating portions 2 where the mating portions 3 are formed.

In the described manner, two connection members 1 are engaged with each other. The component (first component) connected to and communicating with the communicating portion 2 in one of the connection members 1 and the component (second component) connected to and communicating with the communicating portion 2 in the other one of the connection members 1 are mutually connectable to communicate with each other. According to this embodiment, one of the connection members 1 engages into the other connection member 1, while receiving the other connection member 1 engaged therein. According to this embodiment, one connection member 1 has the engaging portions 4 that engage into the other connection member 1, and the engaged portions 5 into which the other connection member 1 is engaged. The components may be engageable with each other using two connection members 1, making external and internal members unnecessary. When these connection members are attached to two components to be connected, therefore, discerning external and internal members, as in the conventional art, is unnecessary, markedly facilitating the workload. It is particularly advantageous to use two connection members 1 of one type that requires only one die to fabricate them. This may reduce the die cost as compared to the conventional example that requires the fabrication of external and internal members, consequently curtailing an overall production cost.

[Another Exemplified Engagement Setup of Connection Member]

Figure 4A:
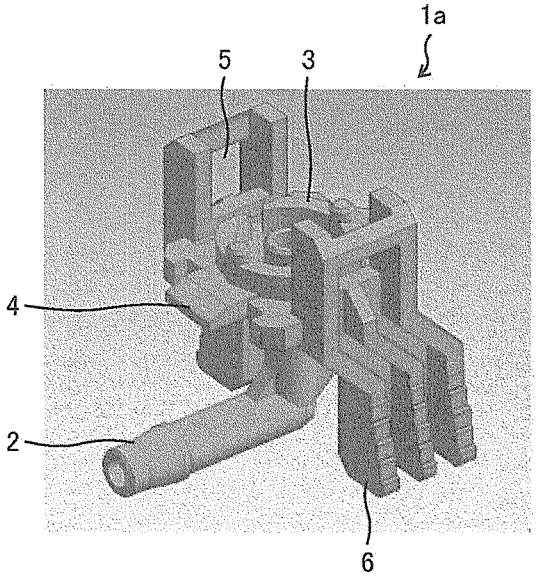
FIGS. 4A and 4B are perspective views of other examples of the connection member.
Figure 4B:
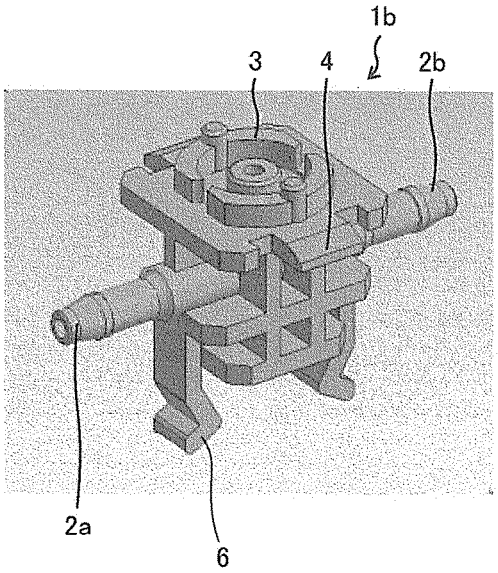

The earlier example has described the connection of two connection members 1. This is, however, a non-limiting example. For example, the connection member 1 according to this embodiment may be engageable with connection members of different types. Examples of such connection members are described below. FIGS. 4A and 4B are perspective views of connection members structured differently to the connection member 1.

The connection member 1 may be engaged with a connection member 1*a* illustrated in FIG. 4A. As with the connection member 1, the connection member 1*a* has a communicating portion 2, a mating portion 3, engaging portions 4, engaged portions 5, and holding portions 6. However, the communicating portion 2 of this connection member, unlike the connection member 1, is bent at its midpoint. By way of the engagement between the connection member 1 and the connection member 1*a*, the engaging portions 4 of the connection member 1 engage into the engaged portions 5 of the connection member 1*a*, and the engaging portions 4 of the connection member 1*a* engage into the engaged portions 5 of the connection member 1. Then, the mating portions 3 of the connection member 1 and the connection member 1*a* are mated with each other. As a result, the component connected to and communicating with the communicating portion 2 of the connection member 1 and the component connected to and communicating with the communicating portion 2 of the connection member 1*a* are mutually connectable to communicate with each other. In the examples illustrated in FIGS. 3A to 3C, the communicating portions 2 of the two connection members 1 are coaxial. On the other hand, the connection member 1*a* described in this example has the communicating portion 2 bent at its midpoint, and thus the communicating portions 2 of the connection member 1 and the connection member 1*a* are oriented differently. Such connection members as the connection member 1*a* having the communicating portion 2 bent at its midpoint may be useful when the direction of communication between two components is desirably changed. It should be understood that the communicating portion 2 of the connection member 1*a* may be bendable through an optional angle.

The connection member 1 may be engaged with a connection member 1*b* illustrated in FIG. 4B. Like the connection member 1, the connection member 1*b* has two communicating portions 2*a* and 2*b*, a mating portion 3, engaging portions 4, and holding portions 6. This connection member, however, differs from the connection member 1 in having two engaging portions 2*a* and 2*b* but no engaged portion 5. When the connection member 1 and the connection member 1*b* are engaged with each other, the engaging portions 4 of the connection member 1*b* engage into the engaged portions 5 of the connection member 1, but not the other way around. Then, the mating portions 3 of the connection member 1 and the connection member 1*b* are mated with each other. As a result, one component connected to and communicating with the communicating portion 2 of the connection member 1 and two components connected to and communicating with the communicating portions 2*a* and 2*b* of the connection member 1*b* are mutually connectable to communicate with one another. This example, wherein the connection member 1*b* has two communicating portions 2*a* and 2*b*, may allow three components to be connected and communicate with one another. In case the three components are pipes, the connection member 1*b* may be useful when changing a flow rate or diverging a flow into sub flows is desirable. It should be understood that the connection member 1*b* may have three or more communicating portions.

This embodiment is not limitedly applicable to the engagement between two connection members 1, the engagement between the connection member 1 and the connection member 1*a*, or the engagement between the connection member 1 and the connection member 1*b*. The connection member 1*a* was described as an example of differently structured connection members. Instead, the connection member 1*a* may be used in place of the connection member 1. This embodiment includes in its scope the engagement between two connection members 1*a* and the engagement between connection members 1*a* and 1*b*. It should be understood that the connection member 1 may have a plurality of communicating portions like the connection member 1*b*.

[An Exemplified Use of Connection Member]

As described above, the connection member 1 may be usable to connect the first pipe 21*a* and the filter 14 of the ink supply unit 10 illustrated in FIG. 2. Specifically, the first pipe 21*a* is communicatably connected to the communicating portion 2 of the connection member 1, and the filter 14 is communicatably connected to another communicating portion of another connection member (for example, another connection member 1). The engaging portions 4 of the connection member 1 engage into the other connection member, while the other connection member engages into the engaged portions 5 of the connection member 1. The mating portion 3 is communicatably mated with another mating portion of the other connection member. Then, the first pipe 21*a* connected to and communicating with the communicating portion 2 of the connection member 1 and the filter 14 connected to and communicating with another communicating portion of the other connection member are mutually connectable to communicate with each other. The same goes for the connection between the first pipe 21*a* and the valve 13, between the second pipe 21*b* and the filter 14, between the second pipe 21*b* and the pump 15, between the third pipe 21*c* and the pump 15, between the third pipe 21*c* and the valve 16, or between the fourth pipe 21*d* and the valve 16.

Figure 5:
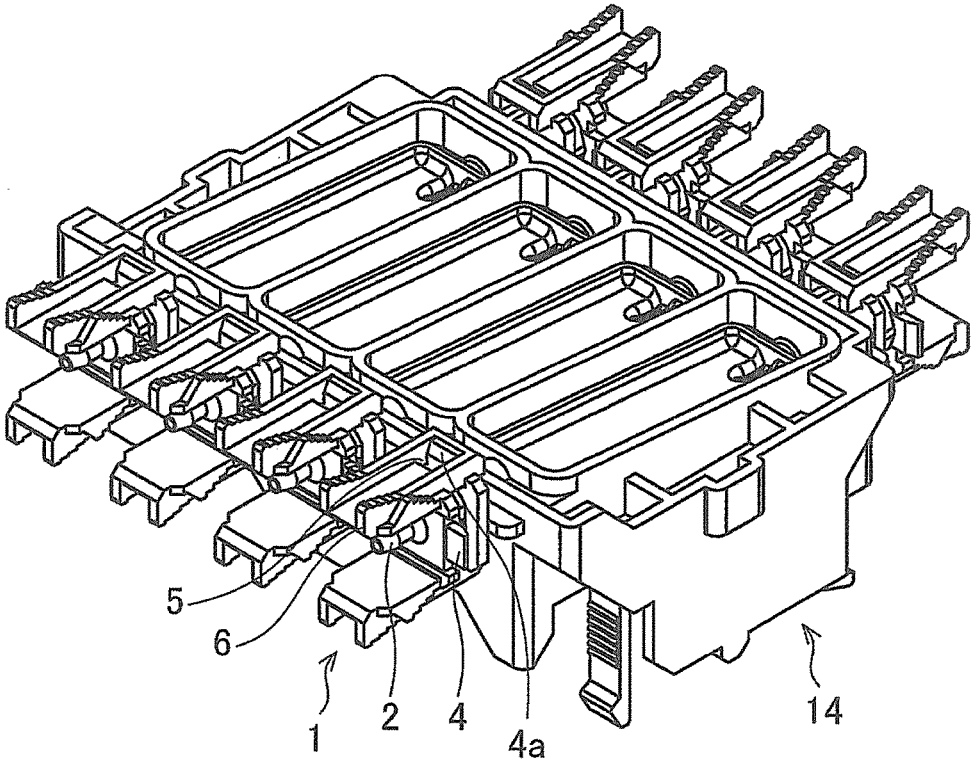
FIG. 5 is a drawing that illustrates the use of a connecting port of a filter as another connection member according to an embodiment of the invention.

Here, the filter 14 is connected to another communicating portion of another connection member, but the invention is not limited to this. For example, the connecting port of the filter 14 may be formed in the same shape as another connection member. This may allow the connecting port of the filter 14 to be directly usable as another connection member. FIG. 5 is a drawing that illustrates the use of the connecting port of the filter 14 as another connection member.

Referring to FIG. 5, engaging portions 4*a* and mating portions (not illustrated in the drawing) are formed at the connecting ports of the filters 14. By engaging the connection member 1 with the connecting port of the filter 14, the engaging portions 4*a* formed at the connecting port of the filter 14 engage into the engaged portions 5 of the connection member 1. Then, the mating portion 3 of the connection member 1 and the mating portion formed at the connecting port of the filter 14 are mated with each other. As a result, the filter 14 and the first pipe 21*a* (not illustrated in the drawing) connected to and communicating with the communicating portion 2 of the connection member 1 are mutually connectable to communicate with each other.

With the connecting port of the filter 14 serving as another connection member, the connection member 1 according to this embodiment may be directly engageable with the filter 14. In this instance, it only takes one connection member 1 to connect the filter 14 and the first pipe 21*a* to communicate with each other. This may reduce a required number of connection members, leading to cost reduction.

Figure 6:
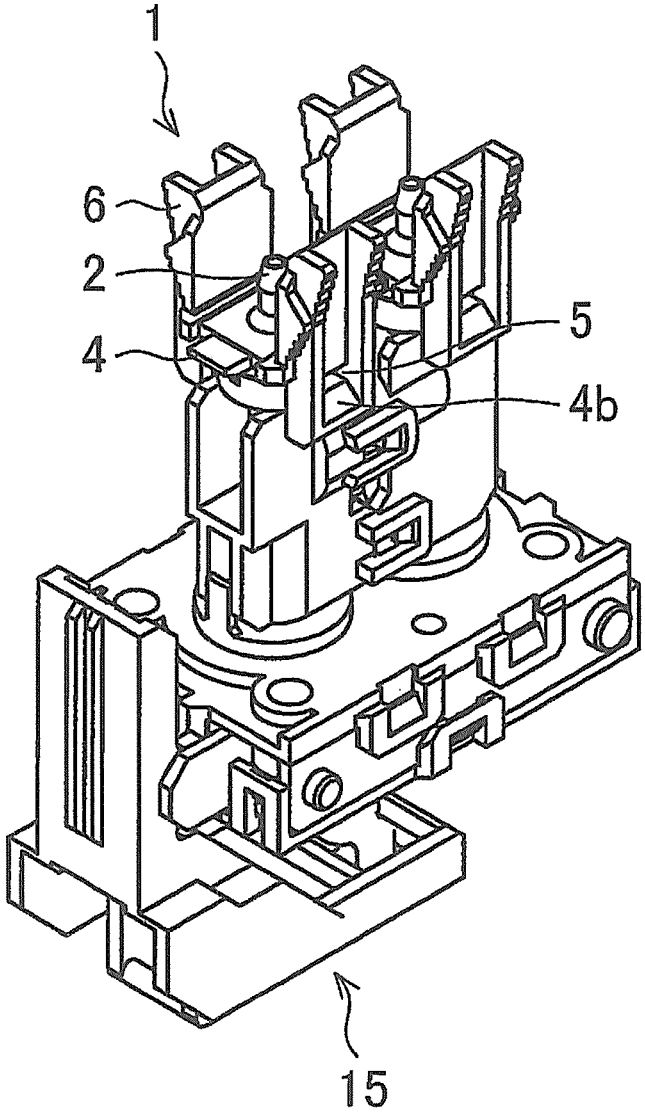
FIG. 6 is a drawing that illustrates the use of a connecting port of a pump as another connection member according to an embodiment of the invention.
Figure 7:
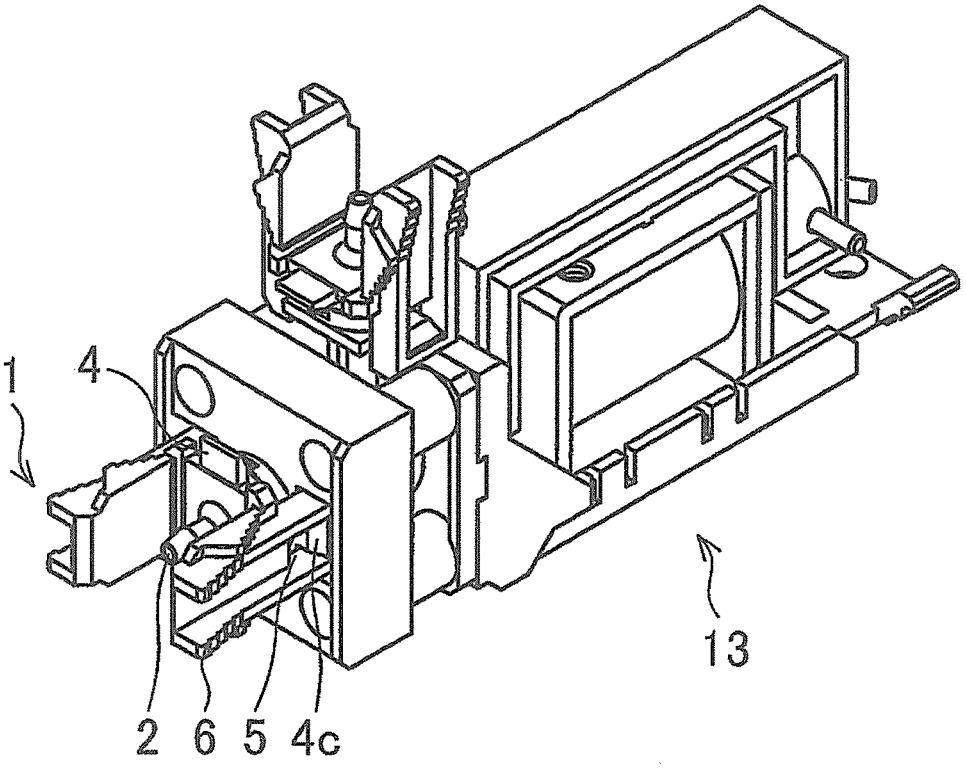
FIG. 7 is a drawing that illustrates the use of a connecting port of a valve as another connection member according to an embodiment of the invention.

Likewise, the connecting ports of the pump 15 and the valves 13 and 16 may be usable as another connection member. FIG. 6 is a drawing of the connecting port of the pump 15 used as another connection member. FIG. 7 is a drawing of the connecting port of the valve 13 used as another connection member.

Referring to FIG. 6, engaging portions 4*b* and a mating portion (not illustrated in the drawing) are formed at the connecting port of the pump 15. By engaging the connection member 1 with the connecting port of the pump 15, the engaging portions 4*b* formed at the connecting port of the pump 15 engage into the engaged portions 5 of the connection member 1. Then, the mating portion 3 of the connection member 1 and the mating portion formed at the connecting port of the pump 15 are mated with each other. As a result, the pump 15 and the component, such as the second pipe 21*b* (not illustrated in the drawing), connected to and communicating with the communicating portion 2 of the connection member 1 are mutually connectable to communicate with each other.

Referring to FIG. 7, engaging portions 4*c* and a mating portion (not illustrated in the drawing) are formed at the connecting port of the valve 13. By engaging the connection member 1 with the connecting port of the valve 13, the engaging portions 4*c* formed at the connecting port of the valve 13 engage into the engaged portions 5 of the connection member 1. Then, the mating portion 3 of the connection member 1 and the mating portion formed at the connecting port of the valve 13 are mated with each other. As a result, the valve 13 and the component, such as the first pipe 21*a* (not illustrated in the drawing), connected to and communicating with the communicating portion 2 of the connection member 1 are mutually connectable to communicate with each other. The same applies to the valve 16, description of which is omitted here.

The connection member 1 may be usable to connect, in addition to the components so far exemplified, other components. For example, the connection member 1 may be usable to connect pipes. By using the connection member 1 for pipe connection, the replacement of pipes may be facilitated, and pipes that differ in inner diameter may be connectable.

[Interval Between Engaging Portion and Engaged Portion]

The connection member 1 according to this embodiment may preferably have an interval between the engaging portions 4 and the engaged portions 5. This interval is a space for the rubber material 7 to be fitted in against another connection member. The engaging portions 4 are located at positions closer to the communicating portion 2 than the engaged portions 5. There is no contact between the engaging portions 4 and the engaged portions 5. Such an interval between the engaging portions 4 and the engaged portions 5 may provide for the advantage described below.

The interval between the engaging portions 4 and the engaged portions 5 may serve to increase a degree of engagement between the connection member 1 and another connection member. As a result, a larger engaging intensity (engaging force) may be attainable, making the connection member and the other connection member inseparable.

In the presence of this interval between the engaging portions 4 and the engaged portions 5, the engaged portions 5 may be more deflectable when the holding portions 6 are gripped. A larger deflection of the engaged portions 5 may facilitate the engagement between the connection member 1 and another connection member.

[Shape of Communicating Portion]

Figure 8:
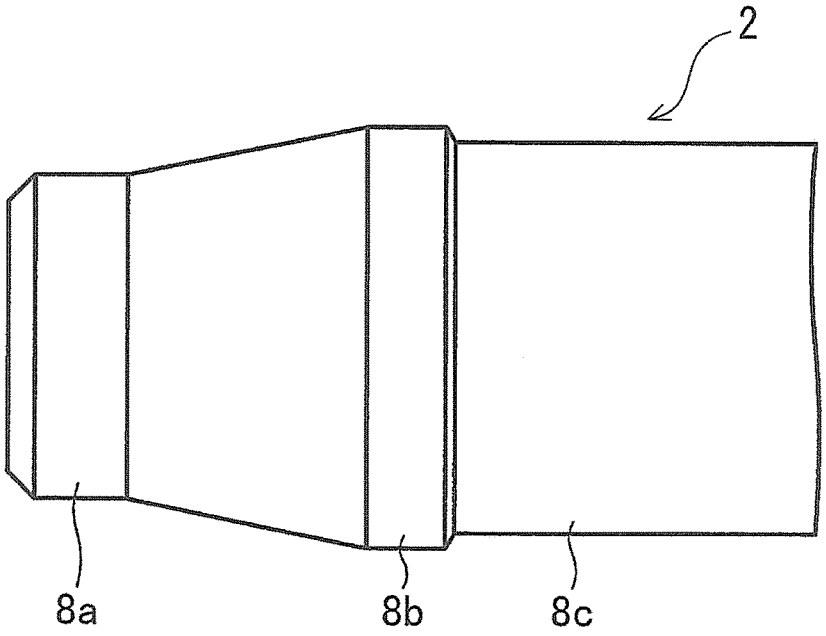
FIG. 8 is an enlarged view of a connecting end of a communicating portion to be connected to a component according to an embodiment of the invention.

FIG. 8 is an enlarged view of the connecting end of the communicating portion 2 to be connected to the component. As illustrated in FIG. 8, the communicating portion 2 preferably has, at its connecting end to be connected to the component, a part 8*b* having a largest aperture whose side surface is parallel to the lengthwise direction. When the part 8*b* having a largest aperture whose side surface is parallel to the lengthwise direction is formed at the connecting end of the communicating portion 2, fully intimate contact may be achieved between this part 8*b* of the communicating portion 2 and the inner surface of the component's connecting port. This may improve sealing properties between the communicating portion 2 and the connecting port of the component, making the connection member and the component inseparable. Because of the improved sealing properties between the communicating portion 2 and the connecting port of the component, any displacement of the connecting port of the component is unlikely to result in a gap between the communicating portion 2 and the connecting port. This may avoid possible leakage of fluid (for example, ink) through such a gap.

As illustrated in FIG. 8, preferably, at the connecting end to be connected to the component, the communicating portion 2 may have a part 8*a* having a smallest aperture whose side surface is parallel to the lengthwise direction at a lower end thereof than the part 8*b* having a largest aperture, and the communicating portion 2 may further have, at a position opposite to the part 8*a* having a smallest aperture across the part 8*b* having a largest aperture, a part 8*c* larger in aperture than the part 8*a* having a smallest aperture and smaller in aperture than the part 8*b* having a largest aperture (i.e., a part having a mid-sized aperture), wherein the part 8*c* has a side surface parallel to the lengthwise direction. When the part 8*a* having a smallest aperture and the part 8*c* having a mid-sized aperture, whose side surfaces are parallel to the lengthwise direction, are formed at the connecting end of the communicating portion 2, fully intimate contact may be further ensured between the parts 8*a*, 8*b* and 8*c* of the communicating portion 2 and the inner surface of the component's connecting port. This may further improve sealing properties between the communicating portion 2 and the connecting port of the component, making the connection member and the component more inseparable.

At the connecting end of the communicating portion 2, a stepwise part is formed between the part 8*b* having a largest aperture and the part 8*c* having a mid-sized aperture. Such a stepwise part (unevenness) may make the communicating portion 2 and the connecting port of the component even more inseparable.

[Additional Remarks]

The connection member 1 according to an aspect of the invention is a connection member 1 to be connected to and to communicate with a first component, the connection member 1 being further connectable to another connection member to be connected to and to communicate with a second component, the connection member 1 including: a communicating portion 2 connectable to and communicatable with the first component; engaging portions 4 engageable into the other connection member; and engaged portions 5 into which the other connection member is engageable, wherein the connection member 1 and the other connection member are mutually connectable to communicate with each other.

By engaging the connection member 1 and the other connection member thus structured with each other, the first component connected to and communicating with the communicating portion 2 of the connection member 1 and the second component connected to and communicating with another communicating portion of the other connection member are mutually connectable to communicate with each other. The connection member 1 according to this embodiment engages into the other connection member, while receiving the other connection member engaged therein. Specifically, the connection member 1 according to an aspect of the invention has the engaging portions 4 that engage into the other connection member, and the engaged portions 5 into which the other connection member is engaged. The components may be engageable with each other using two connection members 1 according to this embodiment, making external and internal members unnecessary. When these connection members are attached to two components to be connected, therefore, discerning external and internal members, as in the conventional art, is unnecessary, markedly facilitating the workload. It is particularly advantageous to use two connection members 1 of one type that requires only one die to fabricate them. This may reduce the die cost as compared to the conventional example that requires the fabrication of external and internal members, consequently curtailing an overall production cost.

In the connection member 1 according to an aspect of the invention, the engaging portions 4 may be located at positions closer to the communicating portion 2 than the engaged portions 5, and the engaging portions 4 and the engaged portions 5 may be spaced at an interval.

In the connection member 1 thus structured, an interval between the engaging portions 4 and the engaged portions 5 may serve to increase a degree of engagement between the connection member 1 and the other connection member. As a result, a larger engaging intensity (engaging force) may be attainable, making the connection member and another connection member inseparable.

According to an aspect of the invention, the communicating portion 2 of the connection member 1 may have a tubular shape, and the communicating portion 2 may have the part 8*b* having a largest aperture whose side surface is parallel to the lengthwise direction.

In the connection member 1 thus structured, the part 8*b* having a largest aperture at the connecting end of the communicating portion 2 has a side surface parallel to the lengthwise direction. Then, fully intimate contact may be achieved between the part 8*b* having a largest aperture and the inner surface of the component's connecting port. This may improve sealing properties between the communicating portion 2 and the connecting port of the component, making the communicating part and the connecting part inseparable. Because of the improved sealing properties between the communicating portion 2 and the connecting port of the component, any displacement of the connecting port of the component is unlikely to result in a gap between the communicating portion 2 and the connecting port. This may avoid possible leakage of fluid (for example, ink) through such a gap.

In the connection member 1 according to an aspect of the invention, the communicating portion 2 may have the part 8*a* having a smallest aperture whose side surface is parallel to the lengthwise direction at a lower end thereof than the part 8*b* having a largest aperture, and the communicating portion 2 may further have, at a position opposite to the part 8*a* having a smallest aperture across the part 8*b* having a largest aperture, the part 8*c* larger in aperture than the part 8*a* having a smallest aperture and smaller in aperture than the part 8*b* having a largest aperture (i.e., a part having a mid-sized aperture), wherein the part 8*c* has a side surface parallel to the lengthwise direction.

In the connection member 1 thus structured, the part 8*a* having a smallest aperture and the part 8*c* having a mid-sized aperture of the communicating portion 2 at its connecting end respectively have side surfaces parallel to the lengthwise direction. Then, fully intimate contact may be further ensured between the inner surface of the component's connecting port and the part 8*a* having a smallest aperture, the part 8*b* having a largest aperture, and the part 8*c* having a mid-sized aperture. This may further improve sealing properties between the communicating portion 2 and the connecting port of the component, making the connection member and the component more inseparable.

At the connecting end of the communicating portion 2, the stepwise part is formed between the part 8*b* having a largest aperture and the part 8*c* having a mid-sized aperture. Such a stepwise part (unevenness) may make the communicating portion 2 and the connecting port of the component even more inseparable.

An inkjet recording device according to an aspect of the invention includes any one of the connection members so far described.

By using any one of the connection members 1 thus structured advantageous and fabricated at low cost, a plurality of components in the inkjet recording device may be easily connected to each other.

The present invention is not necessarily limited to the embodiments described so far and may be carried out in many other forms. The technical scope of the invention encompasses any modifications within the scope of the appended claims and embodiments obtained by variously combining the technical means disclosed herein.

INDUSTRIAL APPLICABILITY

The connection member according to the present invention is suitable for use in connecting two components to establish communication therebetween, for example, valves, filters, pumps, and pipes of an inkjet recording device.

The invention claimed is:

1. A connection member to be connected to and to communicate with a first component, the connection member being further connectable to another connection member to be connected to and to communicate with a second component, and the another connection member having same structure as the connection member, and the connection member comprising:

a communicating portion, being connectable to and communicatable with the first component;

a mating portion, being communicatably formed at the other end of the communicating portion;

two engaging portions, being formed at opposite positions on a side surface of the mating portion; and two engaged portions, being formed at opposite positions crosswise the two engaging portions on a side surface of the mating portion;

wherein the two engaging portions of the connection member respectively engage into the two engaged portions of the another connection member;

the two engaging portions of the another connection member respectively engage into the two engaged portions of the connection member;

the connection member and the another connection member are mutually connectable to communicate with each other.

2. The connection member according to claim 1, wherein a rubber material is inserted in between the mating portion of the connection member and the mating portion of the another connection member, so as to prevent a leakage through a gap generated between the communicating portions.

3. An inkjet recording device, comprising:

the connection member according to claim 2.

* * * * *